US005167063A

United States Patent [19]

Hulsink

[11] Patent Number: 5,167,063

[45] Date of Patent: Dec. 1, 1992

[54] METHOD OF MAKING A TRANSFORMER WINDING IN THE FORM OF A DISC WINDING PROVIDED WITH AXIAL CHANNELS

[75] Inventor: Gerhardus J. Hulsink, Babberich, Netherlands

[73] Assignee: Smit Transformatoren B.V., Nijmegen, Netherlands

[21] Appl. No.: 438,062

[22] Filed: Nov. 20, 1989

[30] Foreign Application Priority Data

Nov. 22, 1988 [NL] Netherlands ..... 8802882

[51] Int. Cl.[5] ..... H01F 41/06

[52] U.S. Cl. ..... 29/605; 242/7.07; 336/207

[58] Field of Search ..... 242/7.07; 336/207, 180, 336/185; 29/605

[56] References Cited

U.S. PATENT DOCUMENTS

| | | | |
|---|---|---|---|
| 1,813,994 | 7/1931 | George | 336/207 X |
| 3,170,225 | 2/1965 | Gray et al. | 29/605 |
| 3,501,727 | 3/1970 | Kafka | 29/605 |

FOREIGN PATENT DOCUMENTS

| | | |
|---|---|---|
| 216249 | 4/1987 | European Pat. Off. . |
| 938496 | 2/1956 | Fed. Rep. of Germany . |
| 1172362 | 6/1964 | Fed. Rep. of Germany . |
| 1277433 | 9/1968 | Fed. Rep. of Germany . |
| 822054 | 10/1959 | United Kingdom . |
| 928072 | 6/1963 | United Kingdom . |
| 991271 | 5/1965 | United Kingdom . |

*Primary Examiner*—Carl E. Hall

*Attorney, Agent, or Firm*—Wegner, Cantor, Mueller & Player

[57] ABSTRACT

A winding for a transformer or choke coil wherein successive turns are arranged onto each other in radial direction. To provide for optimal cooling conditions axially extending cooling channels are provided by placing spacers between the successive radial turns of the winding. To provide for a limited volume, the turns which are adjacent to each other in the axial direction are located directly onto each other without interspacing.

8 Claims, 4 Drawing Sheets

FIG.1
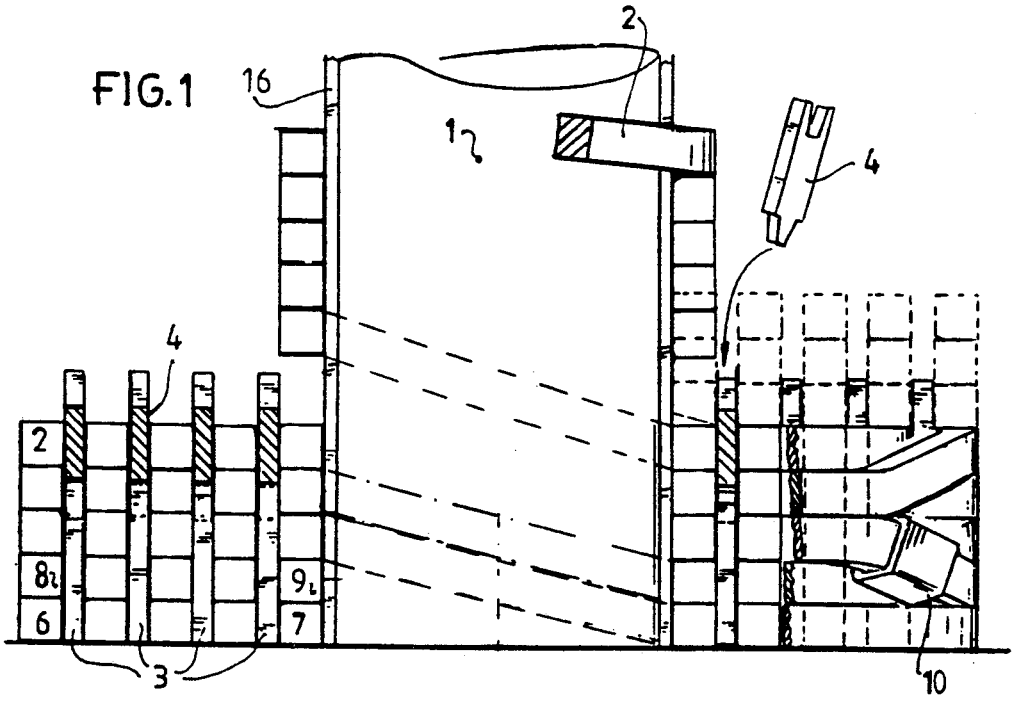
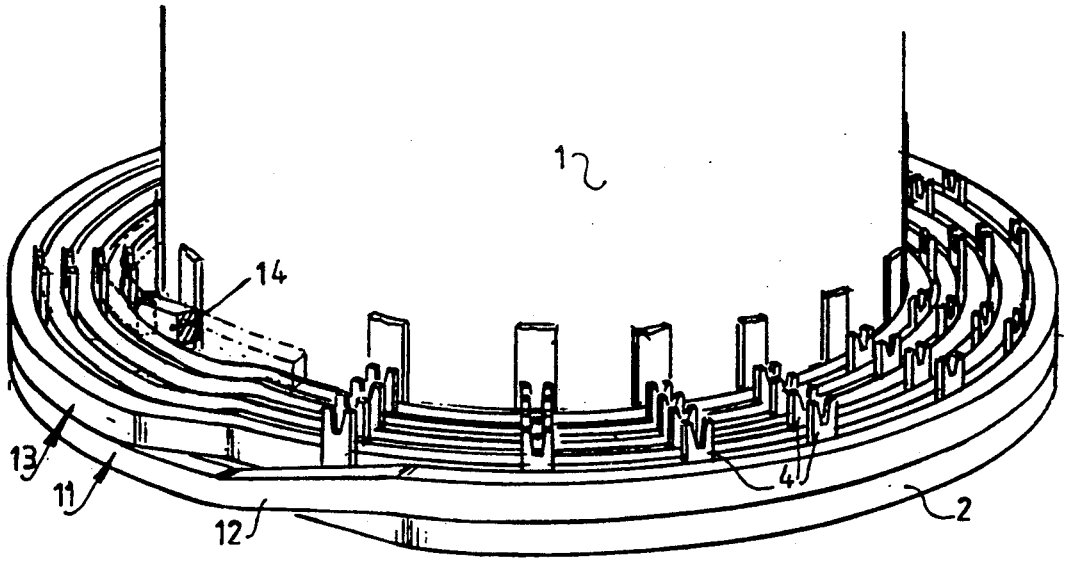
FIG. 2

METHOD OF MAKING A TRANSFORMER WINDING IN THE FORM OF A DISC WINDING PROVIDED WITH AXIAL CHANNELS

The present invention relates to a winding for a transformer or a choke coil, wherein successive turns are arranged onto each other in radial direction.

Such windings are generally known as disc windings; such a winding is known for example from the patent specification GB-A-587997.

A drawback of the sort of windings mentioned in the preamble is that the cooling is not optimal. There are namely only radially extending channels present for cooling, which are formed through the placing of spacer blocks between the separate discs. Without special steps only an inadequate natural circulation of the oil can take place through these channels, so that forced circulation must often be employed, or less optimal cooling properties have to be accepted.

Further windings are known, which do not have the stated drawback of an inadequate oil circulation. These are the so-called layer windings. In these windings the separate turns are placed onto each other in axial direction. As a result of the presence of channels extending in axial direction the cooling is excellent. These windings are however less suitable for use as high voltage windings, since the voltage between turns situated in each others vicinity in adjacent layers is large, so that without special steps the electric strength of such windings is small.

The object of the present invention is the provision of a disc winding as stated in the preamble, wherein an optimal cooling takes place due to the presence of channels extending in axial direction.

This object is achieved in that the turns which lie on each other in radial direction are embodied with a mutual interspacing.

These interspaces lie at the same diameters in all discs and thus form continuous cooling channels in axial direction.

For the forming of such cooling channels, spacers are arranged between successive turns within a disc at regular mutual distances.

The present invention will be further elucidated with reference to the annexed drawings, in which:

FIG. 1 shows a schematic sectional view of a winding according to the present invention;

FIG. 2 shows a schematic perspective view of a winding according to the present invention during the winding process;

Figure 3:
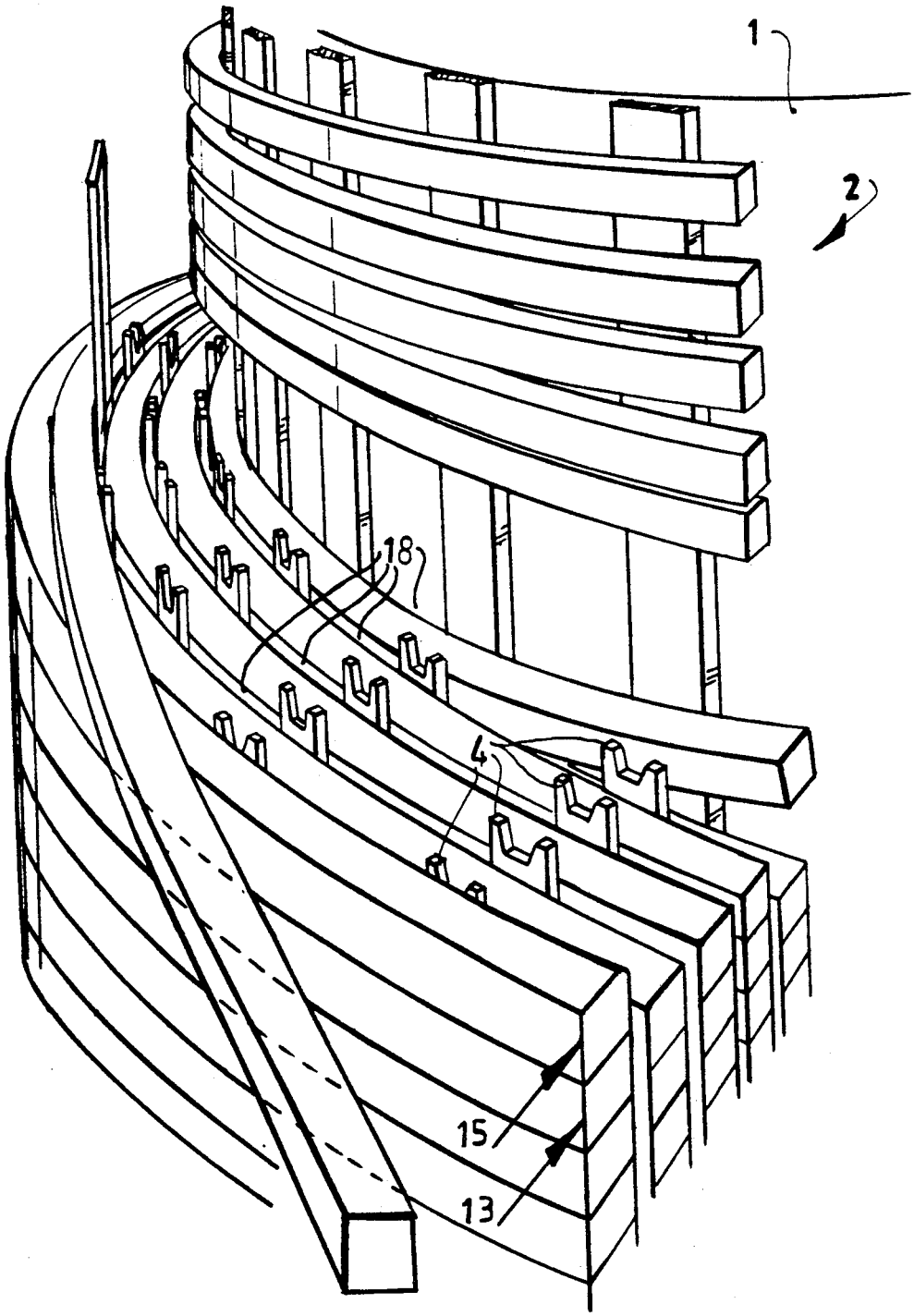
FIG. 3 is a schematic perspective view of the manufacturing of a winding according to the present invention embodied as an interleaved winding.

A winding according to the present invention is wound around a winding core or winding mandrel 1. The winding is formed by conductors 2. Each of these conductors is formed by one or more wires of conducting material, such as copper, which are surrounded by insulating material, for example paper.

The conductors are wound disc by disc. During this winding care is taken to provide interspaces 3 between successive turns. In order to maintain the distances between the separate turns such that the interspaces 3 are created, spacers 4 are arranged at regular intervals between the turns.

After the winding of one disc is completed, the following disc is wound directly adjacent thereto. In a normal disc winding, successive discs are wound alternately from inside to outside and from outside to inside, so that winding can continue normally with the same conductor. Such a winding is shown in FIG. 2.

It is also possible however to use a so-called "interleaved" double coil winding, several examples of which are more extensively described in GB-A-587997. In this case the conductor from the first disc is carried through into the third disc.

In both windings adjoining discs are wound directly against each other, without interspaces. During the winding use is made of the spacers 4. After completion of the winding, channels extending in axial direction have then been created between the keys and the conductors, through which channels the oil can move without extra guidance.

FIG. 2 shows a normally embodied (i.e. not interleaved) winding, in which the steps according to the present invention have been applied.

The winding is started on the inside of the lowest disc 11. After the first turn in completed, an S-bend is arranged in the conductor in order to realize a transition to a greater diameter. Hereafter the second turn is arranged, in which spacers are arranged at regular intervals between the first and the second turns. All the turns of the first previously wound disc are wound in this manner.

The transition is subsequently made to the next disc 13, again by means of an S-bend 12. The turns of this disc are successively arranged from outside to inside, in which each turn is supported by the spacers, which are arranged during the winding of the first disc 11 and which protrude above this disc. On the inside there is then once again a jump in level, as is visible at 14. The then following disc is again, just as the first disc 11, wound from inside to outside; hereby new spacers are arranged in the line of the already present spacers.

The mentioned transitions 12 and 14 between the adjacent discs, as well as the transitions within these discs between the various diameters, are situated for the whole winding in the same portion of the circumference. In this portion no spacers are arranged, and there are therefore no interspaces present between the conductors, because one conductor more is situated here in the same radial dimension than in the rest of the circumference of the winding. In this portion the conductors of two adjacent discs further run alternatingly slanting inward and slanting outward, so that the potential interspaces between the conductors would not emerge directly above each other and so could not form continuous channels in axial direction.

Hereafter will be described how an interleaved winding is wound according to the present invention. Here too the winding consisting of conductors 2 is arranged around a winding mandrel 1. In order to maintain the distance between the separate conductors 2, spacers 4 are also arranged here, so that free spaces 3 are formed between the conductors 2.

The description of the interleaved winding is simplest when a start is made in a situation in which a number of discs are already wound. It is not important hereby whether these above the first disc discs form an interleaved or a normal winding. These above the first disc discs are not shown in FIG. 1.

The starting point in the example is the outside of the lowest disc, that is the turn designated by 6. The turns of the lowest disc that lie more to the inside are then applied until the most inward turn 7 is completed. The newly arranged turns are hereby again supported, just as with the turned winding, by the spacers, which protrude above the underlying disc. Five turns are subsequently arranged directly next to each other on the winding mandrel and the relevant conductor is cut off. This situation is shown in FIG. 1 for a winding which already contains four more discs above the first disc.

Thereafter a second disc is laid directly on top of the first with a new conductor, and this once again starting from the outside, that is from the turn designated by 8. This is then also wound from outside to inside int he manner already described, wherein the interspace between the separate turns is again preserved by the previously arranged spacers which still protrude above the first disc.

When the most inward turn 9 of this disc has been arranged, the third disc is wound from inside to outside, this with the five turns temporarily wound around the winding mandrel. Simultaneously herewith the fourth disc is wound; the same conductor is used for the fourth disc as for the second disc. During the winding of this third and fourth disc new spacers are arranged between the successive turns in line with the spacers already present. When these spacers have an operational height equal to four times the axial dimension of the conductor, these will then protrude two wire heights above the fourth disc. In this way the fifth and sixth disc, which are wound from outside to inside in the same manner as the first and second disc respectively, can be supported by these spacers.

After winding of the third and the fourth disc the ends of the conductors which form the outermost turns of the second and the third disc must be connected to each other. Thus is created a connecting brace which is designated schematically with 10.

The fifth disc is wound with the same conductor as the fourth disc; so this simply runs continuously. The winding procedure for the fifth to the eight disc, and for every following group of four, is further the same as that for the first to the fourth disc.

FIG. 3 shows a schematic perspective view of the winding process during the manufacture of a winding, as described with reference to FIG. 1. In the situation shown in FIG. 3 the lowest disc 13 is wound from outside to inside, wherein the remaining portion of the conductor used herefor is temporarily arranged higher on the winding mandrel 1, while a start is made with the winding of the disc 15 situated directly thereabove. The outermost turn hereof has been arranged, while the arrangement of the turn situated inside it is being carried out.

Figure 4:
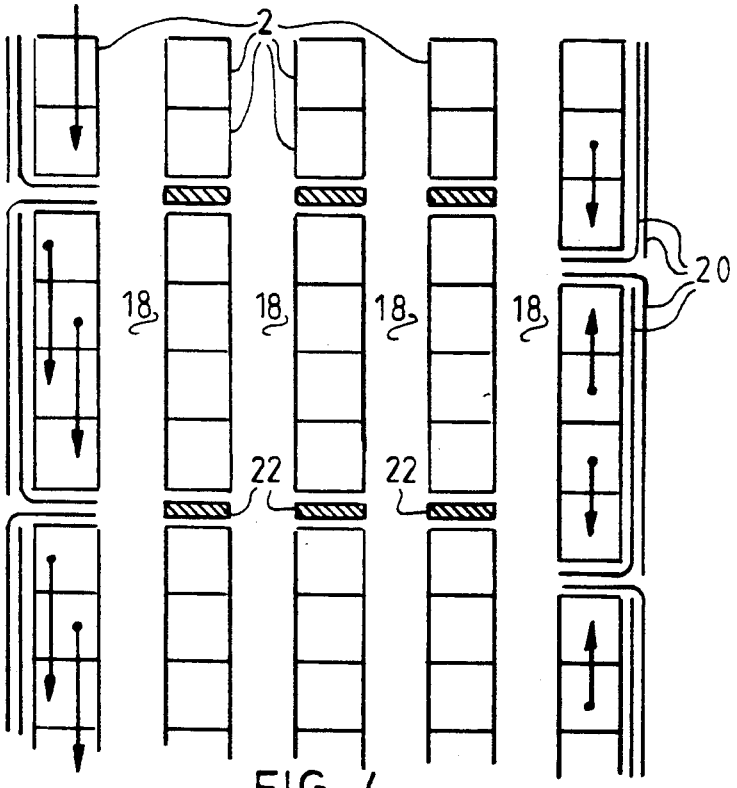
FIG. 4 is a diagram of a winding according to the present invention provided with insulation barriers.

In the winding depicted schematically in FIG. 4 barriers 20 and 21 manufactured from insulating material are arranged round portions of the winding. The barriers 20 are arranged on the outside, wherein a part of the barrier extends inwardly between the outermost turns of two adjacent discs. The barriers 21 are arranged on the inside and extend outwardly in a similar manner between adjacent discs. In both cases care is taken that the channels 18 running in axial direction are not blocked by the barriers. Arranged between the remaining turns of the relevant discs are spacer rings 22 made of insulating material which compensate for the differences in level created by the arrangement of the barriers.

The object of fitting these barriers is to increase the electric strength along the inner and outer sides of the winding. At these locations the electrical field has namely both an axial and a radial component; this in contrast to the field in the cooling ducts 18 which is mainly axially directed. The radial component on the in- and outside of the winding is caused by the other windings or construction parts lying inside and outside the winding, which are at a different electrical potential.

Figure 5:
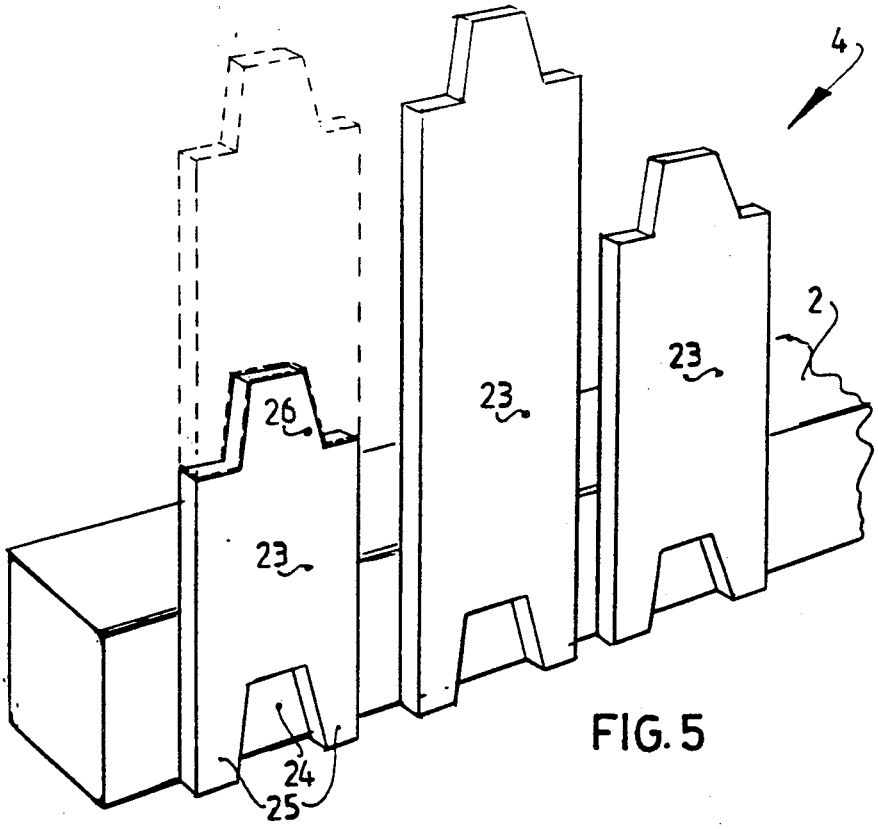
FIG. 5 shows a perspective view of three spacers used in the manufacture of the winding according to the present invention.

In FIG. 5 are shown three different embodiments of the spacers for use in both windings according to the present invention. Each spacers consists of a body 23 provided on the underside with a trapezoidal notch 24, so that on either side of this cut-away portion 24 are created two legs 25, between which an upwardly extending trapezoidal protrusion 26 can be pushed, so that spacers 4 placed above each other can be joined together.

The spacers are dimensioned such that the active height hereof corresponds with for instance the height of two discs, that is, twice the axial dimension of the conductors used.

During manufacture of a normal winding, as described with reference to FIG. 2, the spacers can always be arranged during the outward winding of a disc. Hereafter the turn of the following disc, which is wound from outside to inside, can be laid between the spacers protruding outward from the first-mentioned disc.

During manufacture of an interleaved winding, as described with reference to FIG. 1, the active height of the spacers amounts to four times the height of the conductor. With a transition from the normal to the interleaved type of winding, the most practical height is three times the conductor height.

The present invention is elucidated with reference to a normal disc winding and an interleaved disc winding. It is of course also possible to apply the steps according to the present invention in the case of like windings embodied with parallel conductors. These parallel conductors can then be arranged adjacent to each other in axial and/or radial direction. When the parallel conductors are placed adjacent to each other in radial direction, therefore in the same disc, a winding can then even be realized with an odd number of turns per two discs.

Figure 6:
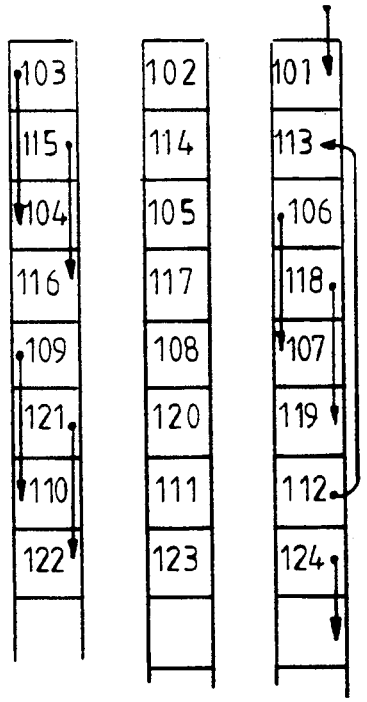
FIG. 6 is a diagram of another possibility of connecting to each other the turns of the various discs of a winding according to the present invention.

In addition it is possible to have the turns run through a different sequence than the interleaved or normal embodiments explained with reference to FIG. 1, 2 and 3. An example of such a winding interleaved in a different manner is schematically indicated in FIG. 6. In this figure the current traverses the turns 101 to 124 inclusive in ascending sequence. The transitions between the various discs necessary for this purpose are designated schematically with arrows. The manufacture of such a winding takes place in a manner similar to that described earlier for the interleaved winding.

The windings of a transformer or a choke coil must of course be able to resist the forces which may occur with short-circuit currents. The electro-magnetic forces developing during a short-circuit load the disc coils, among others, in axial direction. The disc windings usual up until now are less resistant to this, because the spacer blocks arranged between the separate discs reduce the supporting surface of the discs and the winding is hereby pressed together axially more easily. A winding according to the present invention does not need to be provided with these blocks and is therefore much better able to resist short-circuit forces.

It is generally to the benefit of the electric strength of the winding in the case of loading with an impulse voltage if the series capacitance of the winding is large, in particular the series capacitance of the first turns, or the first pair of dics.

This series capacitance is formed from the mutual capacitances of adjacent turns. The further the sequence numbers of the relevant turns lie apart, the greater is the contribution of such a mutual capacitance.

That is, the capacitance between two turns of the same disc, which differ only 1 in sequence number, makes a smaller contribution than the capacitance between turns in adjacent discs. These latter in any case usually lie further apart; for the normal turned winding the maximum difference of the sequence numbers amounts to he number of turns in two discs, minus 1.

With the disc winding usual until now, it is precisely these latter mentioned capacitances between turns in adjacent discs, which could make relatively large contribution to the series capacitance that are small because of the blocks and cooling channels employed between the discs. In a winding according to the present invention on the other hand these capacitances are large because of the omission of radial channels. While on the other hand it is certainly the case that the distance between successive turns in a disc is enlarged, whereby the capacitances associated therewith are smaller, as already explained the contribution thereof to the total series capacitance is much smaller. The result is therefore that because of the steps according to the present invention the series capacitance of the winding is markedly enlarged.

In comparison with the disc windings known up until now, there is also a better possibility with a winding according to the present invention of making use for the conductors of cables consisting of many parallel wires (transposed conductors). This is because these cables display unevenness caused by separate wires changing position. This unevenness is situated on the side surfaces which lie inside and outside during the winding, so that the average distance between successive conductors is enlarged. In a usual disc winding this means that the most important capacitance between the turns is hereby lowered. In a winding according to the present invention the most important capacitance is however situated not between successive turns but between adjacent discs, as already explained. The side surfaces of the cable involved here are relatively flat, so that through the use of cable the capacitance is hardly reduced.

In order to enlarge the series capacitance still further, it is possible to embody the winding as an interleaved disc winding, since this type of winding has an inherently large serial capacity, as already stated in GB-A-587997.

Because the manufacture of an interleaved winding involves more work than a normal winding, it can be advantageous only to embody the first portion of the winding, where in the case of loading with an impulse voltage the greatest voltages naturally occur, as an interleaved winding in order to bring down these voltages to an acceptable level.

The present invention hereby has the advantage that also in the normal embodiment the series capacitance is clearly higher than in a corresponding winding according to the embodiments known until now. Computations can demonstrate that the relative difference between a known disc winding and a winding according to the present invention is even greater in the normal embodiment than in the interleaved embodiment. This means that in the transition from the interleaved to the normal portion the discontinuity in the series capacitance in the embodiment according to the invention is smaller than in a known disc winding. This has the consequence that the localized increase in the impulse voltage load caused by this discontinuity is reduced by applying the steps according to the invention.

Figure 7A:
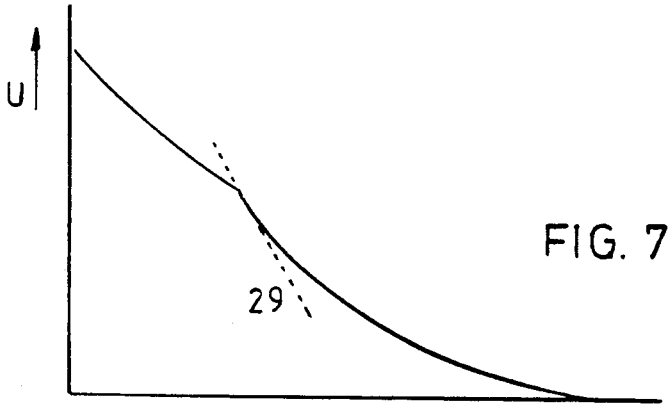
FIG. 7 shows a graph of the impulse voltage distribution in a winding which is partially embodied as an interleaved winding.
Figure 7B:
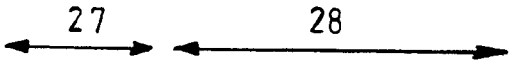
Figure 7B:
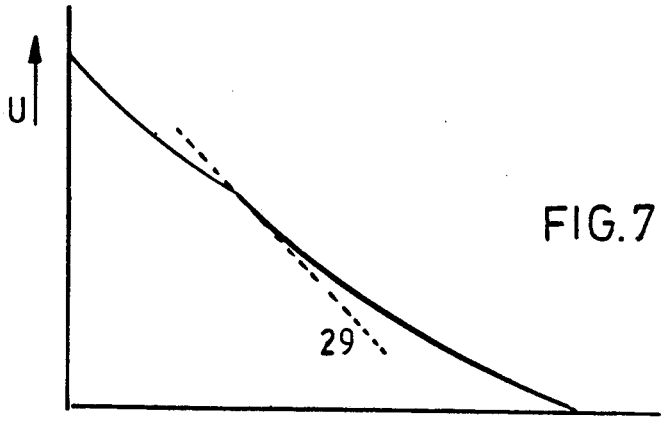

This is shown schematically in FIG. 7, wherein FIG. 7*a* shows the impulse voltage distribution in a winding according to the embodiment known until now, and FIG. 7*b* the distribution in a winding according to the present invention. The voltage load in the normal portion 28 is at its highest at the location where this portion connects to the interleaved portion 27; this load is shown by the slope of the tangents 29.

The combination of an interleaved and a normal winding portion has the further advantage that through a suitable choice of the location of the transition the impulse voltages occurring between the different discs can be still better distributed than in a winding that is embodied entirely as an interleaved winding. Because of its lower series capacitance normal portion in particular will be relatively slightly more heavily loaded, and the loading of the first portion thereby decreases still further.

I claim:

1. In a method for winding a transformer winding or choke coil winding comprising a stack of coaxially oriented discs, each said disc being defined by successive turns of conductor lying adjacent to each other in radial directions relative to a core of said winding, the improvement comprising the steps of:

providing spacers and limiting an active height of each of said spacers to less than an axial height of said winding;

placing said spacers between successive turns of said winding during winding thereof and spacing said spacers apart circumferentially for each said turn during said placing so as to form interspaces between said spacers of each turn during said winding;

stacking said spacers of subsequently wound discs to form axial extensions of previously placed spacers of previously wound discs; and situating said interspaces of each said disc of said stack so as to form corresponding cooling channels which are oriented in an axial direction relative to said core.

2. The method as in claim 1, and further comprising the step of:

coupling said spacers together in said axial direction during said stacking of said spacers.

3. The method as in claim 1, and further comprising the step of:

placing said spacers between said successive turns at regular angular intervals.

4. The method as in claim 1, and further comprising the step of:

winding each successive disc of said stack axially adjacent to, and unspaced from, a previously wound disc of said winding.

5. The method as in claim 4, and further comprising the steps of:

placing said spacers at regular angular intervals between successive turns of a first disc of said stack; and placing additional spacers between successive turns of a next disc of said stack and at the same regular angular intervals.

6. The method as in claim 5, and further comprising the step of;

providing each of said spacers with a height which is greater than a height of a corresponding disc in said axial direction.

7. The method as in claim 4, and further comprising the steps of:

winding successive turns of a first disc of said stack from an inside to an outside of said winding; and winding successive turns of a second disc of said stack from said outside to said inside of said winding.

8. The method as in claim 4, and further comprising the steps of:

winding successive turns of a first disc of said stack from an outside to an inside of said winding; and winding successive turns of a second disc of said stack from said inside to said outside of said winding.

* * * * *